US006085550A

United States Patent [19]

Ishida

[11] Patent Number: 6,085,550

[45] Date of Patent: Jul. 11, 2000

[54] ADJUSTABLE ARTICLE OF JEWELRY AND RELATED METHOD

[76] Inventor: Mitsugi Ishida, 579 Fifth Ave., Suite 850, New York, N.Y. 10017

[21] Appl. No.: 09/020,376

[22] Filed: Feb. 9, 1998

[51] Int. Cl.[7] ..... A44C 9/02

[52] U.S. Cl. ..... 63/15.65; 63/3; 63/3.1; 63/3.2; 63/9; 63/15; 24/68 J; 24/70 J; 24/585

[58] Field of Search ..... 63/3, 3.1, 3.2, 63/9, 15, 15.5, 15.65, 41; 24/68 J, 70 J, 585

[56] References Cited

U.S. PATENT DOCUMENTS

| | | | |
|---|---|---|---|
| 175,057 | 3/1876 | Eisele | 63/15.65 |
| 263,920 | 9/1882 | La Grange | 63/15.65 |
| 1,627,776 | 5/1927 | Haumerson | 24/585 |
| 1,764,440 | 6/1930 | Gammell et al. | 24/68 J |
| 1,786,943 | 12/1930 | Gammell | 24/68 J |
| 1,801,159 | 4/1931 | Hunter | 24/585 |
| 1,997,836 | 4/1935 | Steinberg | 24/68 J |
| 2,598,597 | 5/1952 | Philippe | 24/68 J X |
| 3,204,426 | 9/1965 | Armstrong | 63/15.5 |
| 3,228,208 | 1/1966 | Silverman | 63/5 R |
| 4,615,185 | 10/1986 | Bollinger . | |

FOREIGN PATENT DOCUMENTS

| | | | |
|---|---|---|---|
| 648631 | 9/1962 | Canada . | |
| 679311 | 4/1930 | France | 24/585 |
| 506985 | 9/1930 | Germany | 24/585 |

*Primary Examiner*—Terry Lee Melius
*Assistant Examiner*—Andrea Chop
*Attorney, Agent, or Firm*—Ladas & Parry

[57] ABSTRACT

An adjustable ring is provided which consists of pivotally linked sections. One section is made of two telescopically engaged parts. One of these parts includes holes. The other part includes an axially displaceable element mounted on a pivotal segment of a decorative structure of the ring for engaging in the holes.

20 Claims, 2 Drawing Sheets

ADJUSTABLE ARTICLE OF JEWELRY AND RELATED METHOD

FIELD OF INVENTION

This invention relates to articles of jewelry and associated methods, and more particularly to structures and methods specially adapted for providing adjustable finger rings, bracelets, and the like.

BACKGROUND OF THE INVENTION

In U.S. Pat. No. 263,920 which issued Sep. 5, 1882, R. J. LaGrange discloses a structure for a ring. In this ring, an expansible and contractile band is provided with a rack and pinion and a locking head. In this head, the ends of the band pass through hollow or grooved sections and are controlled by cooperation between the rack and pinion for adjusting the size of the ring. A head portion is furthermore provided which is adapted for being engaged by a key or some other such implement so that the pinion can be rotated so that the ends of the band are moved in or out of the head portion thereby contracting or expanding the band. This ring structure requires a flexible material for constituting the band which of necessity is of a limited thickness and cannot be rigid in structure. The flexibility of the band may permit the adjustment described but, if the material of the band were to be thick and substantial, such a construction could not assume the relative positions necessary to enable the rack and pinion to work properly.

In U.S. Pat. No. 3,228,208, M. Silverman discloses an adjustable finger ring which is subject to the same criticism. Therein, a band is provided the ends of which pass into a space wherein teeth are located. One of the ends of the band has a hole therein accommodating a small ball or bead which can be displaced radially to occupy positions between spaces intermediate a number of teeth or projections. The band which is provided must necessarily be flexible to a substantial degree to accommodate the operation which is described. If the band were to be of a substantial material, the ends of the band could not assume the attitudes necessary for the ends of the band to be accommodated in the aforementioned space. Thus, the nature of the materials which can be employed in fabricating the ring which is described is severely limited.

H. Bollinger discloses a flexible band for a watch in U.S. Pat. No. 4,615,185. A bracelet clasp is provided which includes a sleeve attached to one of the bracelet tongues. The sleeve includes transverse teeth which cooperate with complementary teeth positioned on the other tongue of the bracelet. These teeth are disposed in what could be described as a radial attitude. The sleeve is elastically deformable in order to allow radial displacement and thereby disengagement of the teeth for the opening of the bracelet.

SUMMARY OF THE INVENTION

It is one object of the invention to provide an improved article of jewelry or the like and an improved method related thereto.

It is another object of the invention to provide an improved article of jewelry which is of selectively adjustable size.

Yet another object of the invention is to provide an improved article of jewelry having a geometrical form with an adjustable size effected by an axial rather than a radial movement of a stop to engage between teeth which allows the adjustment in size.

Yet another object of the invention is to provide an improved article of jewelry wherein a portion of the mechanism which allows adjustment forms part of the decorative structure on the article.

In achieving the above and other objects of the invention, there is provided an article of jewelry which comprises a plurality of rigid sections with connections being provided for connecting the sections in a closed geometrical form. One of these sections is designed to include first and second parts adapted for assuming different relative positions establishing different extensions of the parts relative to one another. A locking arrangement is furthermore provided which releasably holds these parts in at least a selected one of the relative extensions. In this arrangement, the parts in the selected relative extensions establish a selected size for the closed geometrical form.

In accordance with a preferred embodiment of the invention, the connections include pivots which pivotally connect the aforenoted sections together. In a preferred arrangement, the geometrical form noted above is generally circular and the aforenoted sections are arcuate in shape. In further accordance with the preferred arrangement, the parts are provided as two parts adapted for a nesting or telescopic relationship with each other and are respectively connected to the pivots of adjacent section to facilitate the assumption of the nesting relationship which might not otherwise be possible to achieve.

More particularly, the parts noted above include a tongue and a tube or sleeve which receives the tongue. In one preferred embodiment of the invention, one part includes a series of teeth constituting a rack. The other part includes a yieldable displaceable stop to engage selectively between the teeth to fix the relative positions of the two parts.

It will be noted in the description which follows hereinbelow that the displacement of the stop takes place in a generally axially aligned direction relative to the geometrical form of the article of jewelry thus formed. This has various advantages including the avoidance of interfering with the decorative perception of the article. Moreover, it facilitates making the adjustments as a part of the decorative structure of the article.

DETAILED DESCRIPTION OF THE INVENTION

One embodiment of the invention illustrated in FIGS. 1–4 involves features of construction whereby adjustment of ring size is possible while accommodating a displacement of sections which might otherwise prevent the adjustment from being achieved.

Figure 1:
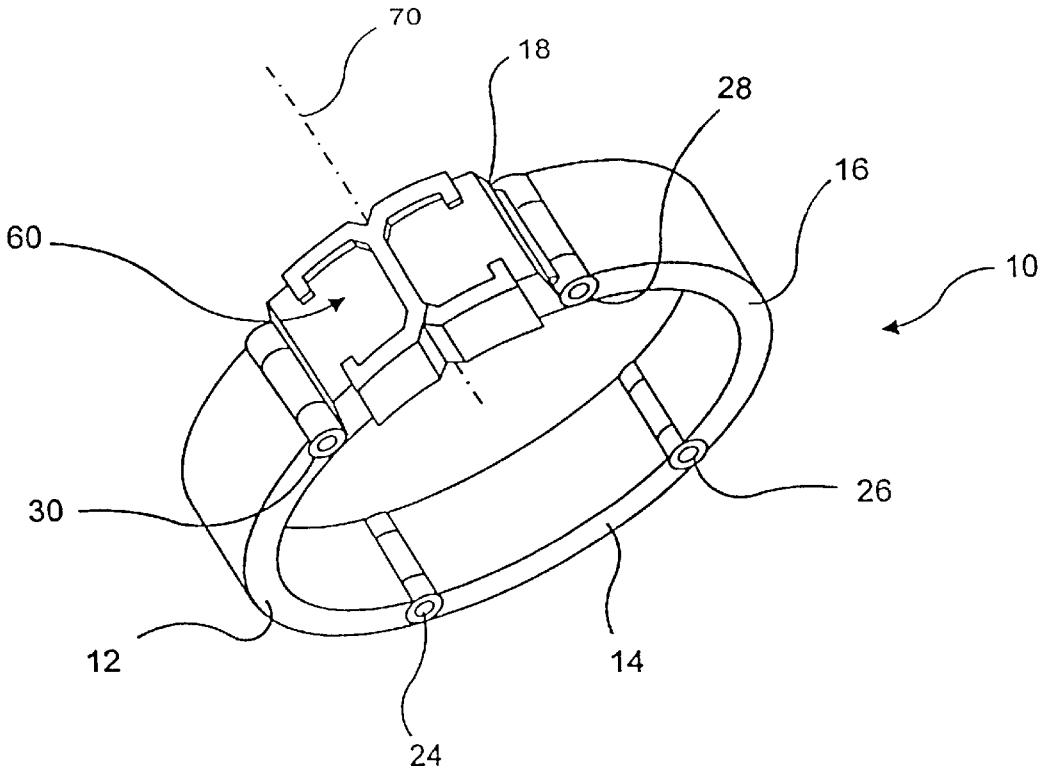
FIG. 1 is a perspective view of a ring embodying features of the invention.
Figure 2:
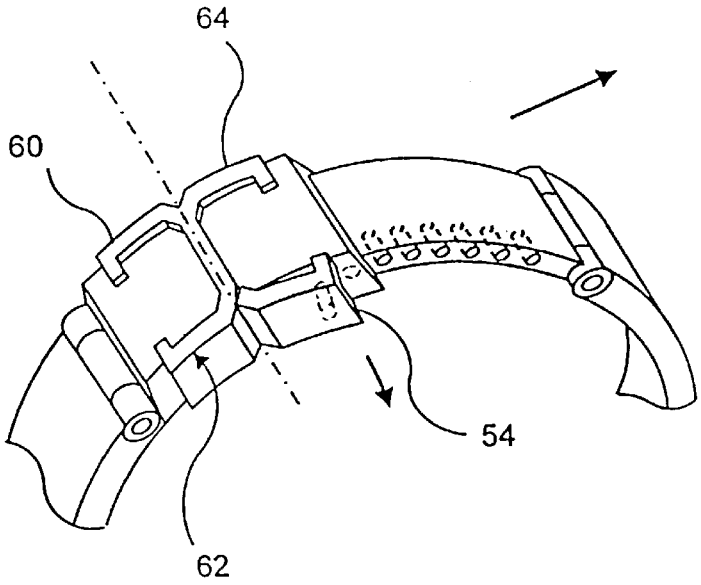
FIG. 2 is a perspective view corresponding to FIG. 1 illustrating the locking device in withdrawn position to permit adjustment of ring size.
Figure 3:
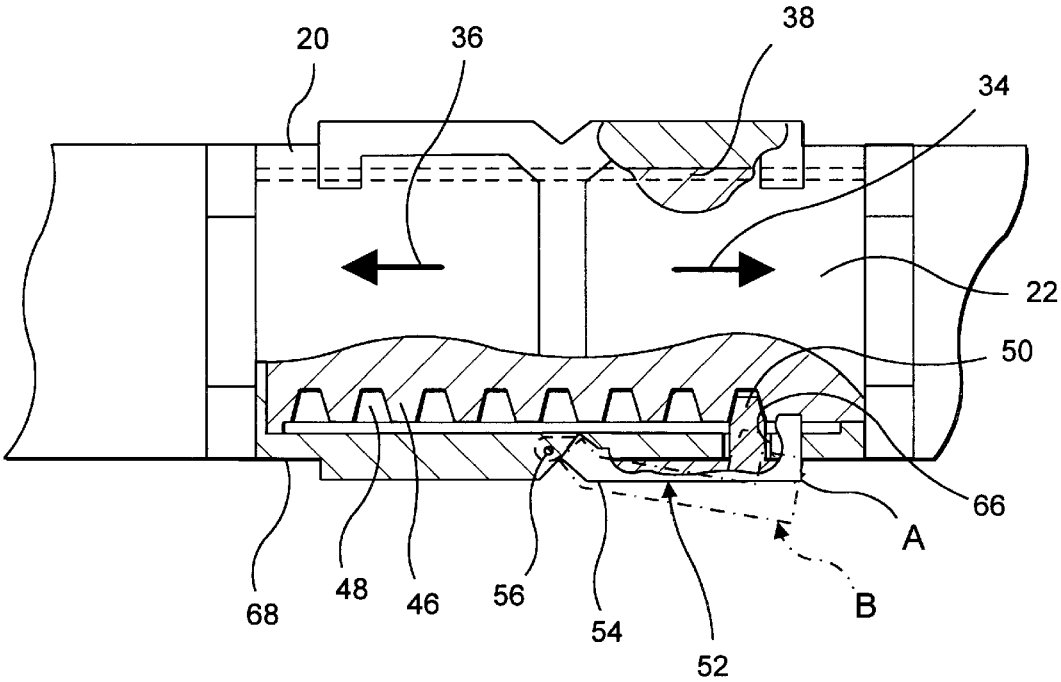
FIG. 3 is an enlarged somewhat diagrammatic view of details of the locking device of the invention.

More particularly, in FIGS. 1 and 2 is illustrated a finger ring 10 inclusive of sections 12, 14, 16 and 18. Ring section 18 includes parts 20 and 22 (see FIG. 3). Sections 12 and 14 are connected by a pivot 24, Sections 14 and 16 are connected by pivot 26, Sections 16 and 18 are connected by pivot 28; and sections 12 and 18 are connected by pivot 30. Thus, the sections are pivotally connected together. This permits the assumption of relative positions between the sections during size adjustment whereby to permit appropriate movement of part 22 within part 20 without interfering with relative movement between the parts and without resulting in a binding of the parts. Withdrawal of part 22 from part 20 (FIG. 3), for example, may take place in the direction indicated by arrow 34 whereas penetration of part 22 into part 20 may take place as shown in FIG. 3 in the direction illustrated by arrow 36.

Four sections 12, 14, 16 and 18 are illustrated in the preferred embodiment although a greater or lesser number of sections is possible within the scope of the invention. Thus, for example, there may be six such sections whereupon the segments will each constitute one sixth of the total circumference of the ring. The preferred geometrical form is circular for a ring. The preferred geometrical form for a bracelet, for example, would be elliptical.

In the preferred embodiment, there are four sections with each section constituting approximately one fourth of the total circumference of the ring. The utilization of parts 20 and 22 in adjustable nesting or telescopic relationship permits the adjustment of the ring size. Thus, the ring can be adjusted to accommodate various finger sizes. Moreover, the ring can be readily mounted on a finger having an enlarged knuckle since, after being slipped over the enlarged knuckle, the size of the ring can be readily decreased to the smaller size of the finger.

The part 20 is provided with an interior passage 38. Part 20 and passage 38 are of arcuate configuration as are the sections 12, 14, 16 and 18. The pivotal movement which is possible between these sections facilitates a positional adjustment of the part 22 as this part is being inserted into and adjusted in the passage 38.

From what is seen in FIG. 3, it follows that the tube or sleeve is provided with an arcuate slot and that the unlocking mechanism 52, the details which will be explained hereinafter, is accommodated at least in part in the slot.

As illustrated in the sectional part of FIG. 3, the part 22 is provided with a plurality of teeth 46 separated by gaps 48, which are the side-holes spaced along the axial front outside edge as shown in FIG. 2. Accommodated selectively in one of the gaps 48 is a stop 50 which is intended to interact with teeth 50 to limit the movement of part 22 relative to part 20. This engagement, which prevents movement between parts 20 and 22, is controllable by the locking (or unlocking) mechanism 52 which supports and includes the stop 50 which is mounted on the segment 54 in turn pivotally mounted on the part 20 by pivot 56.

More specifically, the locking or unlocking mechanism 52 includes the pin or rod 52 constituting the stop 50 which is pivotally actuated. Displacement of the segment 54 and the resulting displacement of rod or pin 50 selectively brings rod or pin 52 into or out of engagement with the teeth 46. A spring-like member (discussed hereinafter) which may be a coil on pivot 56 normally urges the stop to extend into a gap 48 whereby free movement between the part 22 and part 20 is prevented. Displacement of the locking mechanism from position A to position B, however, permits selective adjustment of the extension between the relatively displaceable parts 20 and 22 to select ring size.

If the sections 12, 14, 16, and 18 were to be solidly connected as, for example, in a one-piece or monolithic structure, the displacement of part 22 in passageway 38 might cause a displacement of part 22 relative to part 20 which could possibly cause a binding between these two parts. The provision of pivots 24, 26, 28 and 30 permits the part 22 to assume an appropriate position relative to the part 20 to prevent this kind of interference from taking place.

As appears in FIGS. 1 and 2, the illustrated ring includes a decorative structure 60, more specifically in the shape of two C's 62 and 64 in back-to-back partially overlapping relation. In another embodiment (not shown), diamonds can be variously placed thereon. Element 54 of lock 52 is included as part of C-shaped element 64 and, as shown in FIGS. 2 and 3, is manually displaceable from closed position A to open position B. This displaces stop 50 in opening 66 in wall 68 of part 20 in an axial direction relative to the geometrical form of the ring, the axis 70 of which appears in FIG. 1. Displacement of stop 50 frees part 22 to move or telescope under manual control in either of directions 34 or 36 thereby to modify the size of the ring.

While shapes other than C-shapes may be used in accordance with the invention, the illustrated form shows how, in accordance with the invention, the inclusion of a lock is readily and beautifully camouflaged as part of the decorative scheme. Moreover, since movement of the lock and stop is in axial direction, the opening for the stop is artfully concealed and likelihood of contact with the wearer is suitably minimized.

It is to be noted that while movement in direct axial direction (relative to the geometrical form) has been shown, advantages of the invention can be obtained while using other than direct axial direction since some degree of slope can be accommodated. In all instances, however, it is preferred that the degree of axial displacement exceed the concomitant degree of radial displacement (which in the illustrated embodiment is nil).

Figure 4:
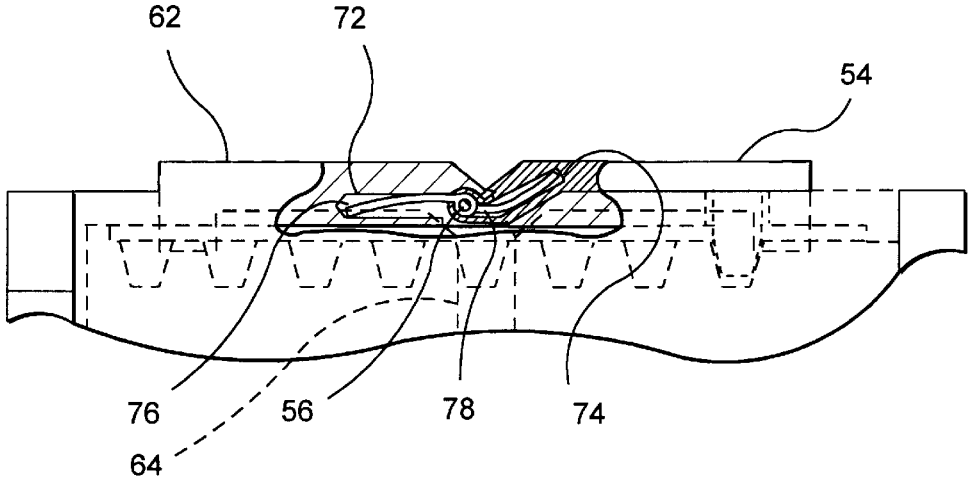
FIG. 4 diagrammatically illustrates the form of a spring which can be used in the article.

FIG. 4 illustrates one form of spring loading for element 54. Therein element 54 is provided with a small interior bore or opening and C-shaped element 62 is provided with an opening 72. These openings respectively receive ends or tails 74 and 76 of coil spring 78 encircling pivot 56 and acting to hold the lock in closed position with the stop in a position of interference with the teeth.

According to the method of the invention, the sections of an article of jewelry such as a ring are preferably rigid and of substantial size or thickness. The article is formed by these sections being pivotally connected. At least one of these sections is formed of relatively displaceable or adjustably nestable parts. In accordance with invention, a tongue penetrates into an associated tube or sleeve in a generally circumferential sense relative to the associated geometrical form. Adjustment of the size of the adjustable section is provided, for example, according to the depth of penetration of the tongue part into the associated sleeve part. Binding of the tongue in the sleeve is prevented during displacement of the tongue in circumferential direction relative to the associated sleeve or part. Certain advantages of the invention are obtained by providing a lock consisting of axially extending teeth with which cooperates an axially displaceable stop. Moreover, in accordance with the invention, the stop is made as a part of the decorative structure of the article.

There will now be obvious to those skilled in the art many modifications and variations of the methods and structures set forth hereinabove. These modifications and variations will not depart from the scope of the invention if defined by the following claims or if equivalent thereto.

What is claimed is:

1. An adjustable article of jewelry comprising:

four to six sections; and connecting means for pivotally connecting said sections in a closed geometrical form, said geometrical form defining an opening and an axis through said opening, wherein one of said sections includes first and second parts in extension of one another for assuming different relative positions which establish effective lengths of said one of said sections, and locking means for releasably holding said parts in at least a selected one of said relative positions, whereby said parts in said selected one of said relative positions establish a selected size for said closed geometrical form, and wherein said locking means includes a sequence of side-holes spaced on one outside of one of said parts, and being located axially relative to said axis of said closed geometrical form, and an element on an outside of the other of said parts, said element being displaceable at least in a substantially axial direction relative to said axis of said closed geometrical form to engage in a selected one of said side-holes to lock said parts together in said selected one of said relative positions.

2. The adjustable article of jewelry as claimed in claim 1 wherein said connecting means includes a pivot coupling said sections together.

3. The adjustable article of jewelry as claimed in claim 2 wherein said parts are adapted for a nesting relationship with each other.

4. The adjustable article of jewelry as claimed in claim 3, wherein said element has a pivot axis perpendicular to said axis of said closed geometrical form.

5. The adjustable article of jewelry as claimed in claim 2, wherein said element has a pivot axis perpendicular to said axis of said closed geometrical form.

6. The adjustable article of jewelry as claimed in claim 1 wherein said geometrical form is generally circular and said sections are arcuate.

7. The adjustable article of jewelry as claimed in claim 6, wherein said element has a pivot axis perpendicular to said axis of said closed geometrical form.

8. The adjustable article of jewelry as claimed in claim 1 and further comprising releasing means displaceable for withdrawing said element from said selected one of said side-holes to permit adjusting said relative positions of said first and second parts.

9. The adjustable article of jewelry as claimed in claim 8, wherein said element has a pivot axis perpendicular to said axis of said closed geometrical form.

10. The adjustable article of jewelry as claimed in claim 1 and further comprising spring means operatively associated with said element to urge said element yieldably into said selected one of said side-holes.

11. The adjustable article of jewelry as claimed in claim 10, wherein said element has a pivot axis perpendicular to said axis of said closed geometrical form.

12. The adjustable article of jewelry as claimed in claim 1 and further including a decorative structure on said one of said sections, said decorative structure including said element.

13. The adjustable article of jewelry as claimed in claim 12 wherein said parts are telescopically engaged and respectively support said element and side-holes.

14. An article of jewelry as claimed in claim 13 wherein said decorative structure includes back-to-back open polygonal elements in partially overlapping relation, one of the polygonal elements including said element.

15. The adjustable article of jewelry as claimed in claim 14, wherein said element has a pivot axis perpendicular to said axis of said closed geometrical form.

16. The adjustable article of jewelry as claimed in claim 1, wherein said element has a pivot axis perpendicular to said axis of said closed geometrical form.

17. In a method of forming a ring of adjustable size, the improvements comprising:

forming four to six arcuate sections, wherein the forming of one of the sections includes forming two telescopically engaged parts one of which is a tongue and the other of which is a sleeve;

inserting the tongue in the sleeve and pivotally connecting the sections together to form a ring defining an axis therethrough, the pivotal connecting of the segments enabling the tongue to move readily within the sleeve;

forming axially extending spaced side-holes on an axial outside, relative to the axis of the ring, of one of the parts and an axially displaceable, relative to the axis of the ring, element on an outside of the other of the parts, the element being for locking the tongue in an adjusted position by axially displacing, relative to the axis of the ring, the element into a selected one the side-holes;

and displacing the element into a selected one of the side-holes;

whereby to provide the ring with an adjustable size.

18. The method of forming a ring of adjustable size according to claim 17 and further comprising forming a decorative structure on said one of said sections and mounting part of the decorative structure pivotally on said other part to support said element.

19. The method of forming a ring of adjustable size according to claim 18, wherein the element has a pivot axis perpendicular to the axis of the ring.

20. The method of forming a ring of adjustable size according to claim 17, wherein the element has a pivot axis perpendicular to the axis of the ring.

* * * * *